US010772470B2

(12) United States Patent
White

(10) Patent No.: US 10,772,470 B2
(45) Date of Patent: Sep. 15, 2020

(54) DRY FLOOR BATH TUB

(71) Applicant: William White, Lake Park, GA (US)

(72) Inventor: William White, Lake Park, GA (US)

( * ) Notice: Subject to any disclaimer, the term of this patent is extended or adjusted under 35 U.S.C. 154(b) by 0 days.

(21) Appl. No.: 15/950,761

(22) Filed: Apr. 11, 2018

(65) Prior Publication Data

US 2018/0249866 A1 Sep. 6, 2018

Related U.S. Application Data

(60) Provisional application No. 62/636,209, filed on Feb. 28, 2018.

(51) Int. Cl.
*A47K 3/00* (2006.01)

(52) U.S. Cl.
CPC ..... *A47K 3/001* (2013.01)

(58) Field of Classification Search
CPC ..... A47K 3/001
USPC ..... 4/584
See application file for complete search history.

(56) References Cited

U.S. PATENT DOCUMENTS 1,781,325 A * 11/1930 Dowling ..... A47K 3/02 4/591
6,360,380 B1 * 3/2002 Swart ..... A61H 33/0087 4/541.1
7,269,861 B1 * 9/2007 Miller ..... A47K 3/302 4/609
8,752,219 B2 * 6/2014 Hoernig ..... E03C 1/24 4/578.1
2005/0246830 A1 * 11/2005 Galyean, Jr. ..... A61H 33/0087 4/584

* cited by examiner

*Primary Examiner* — Christine J Skubinna

(57) ABSTRACT

Bath tubs have been around for many hundreds of years, however the bath tub & shower combination not as long. The bath and shower combination has its conveniences, it gives the user a choice; the choice of just taking a tub bath, a shower or both.

Figure 1:
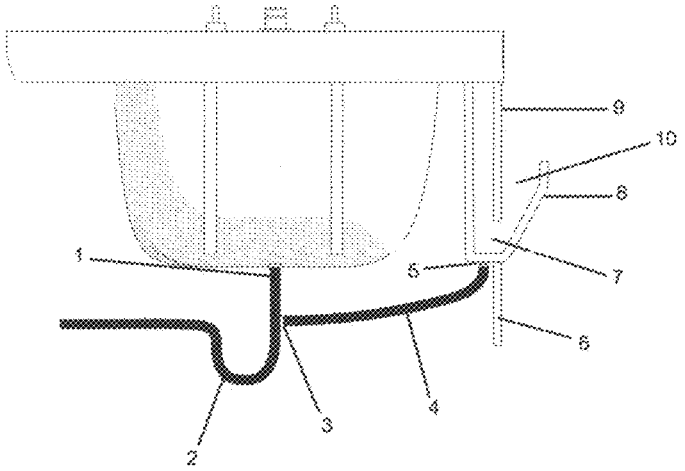
Figure 2:
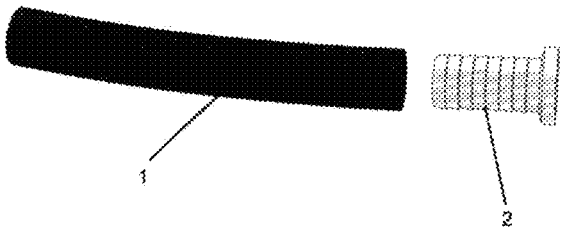
Figure 3:
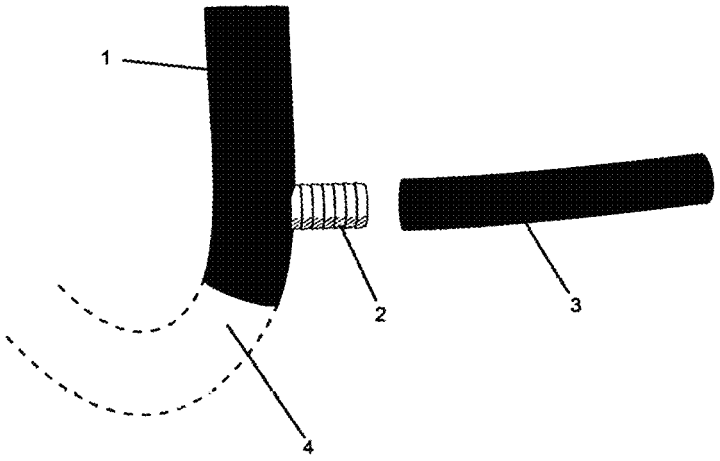
Figure 4:
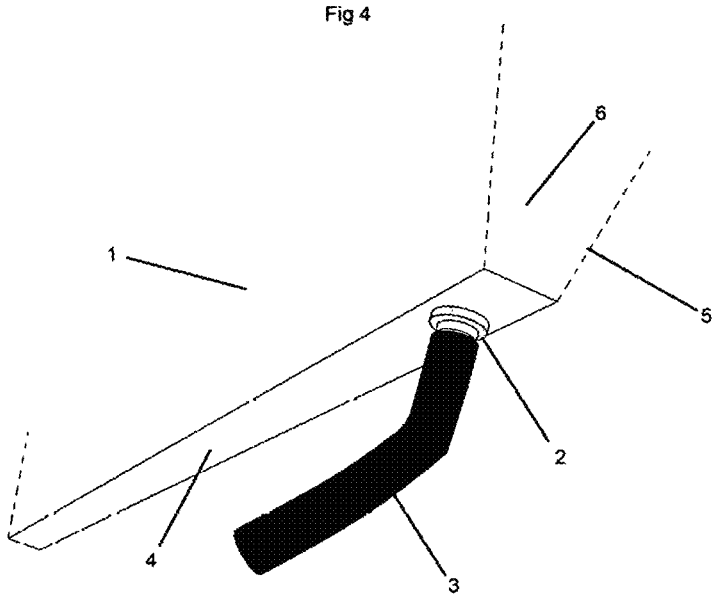
Figure 5:
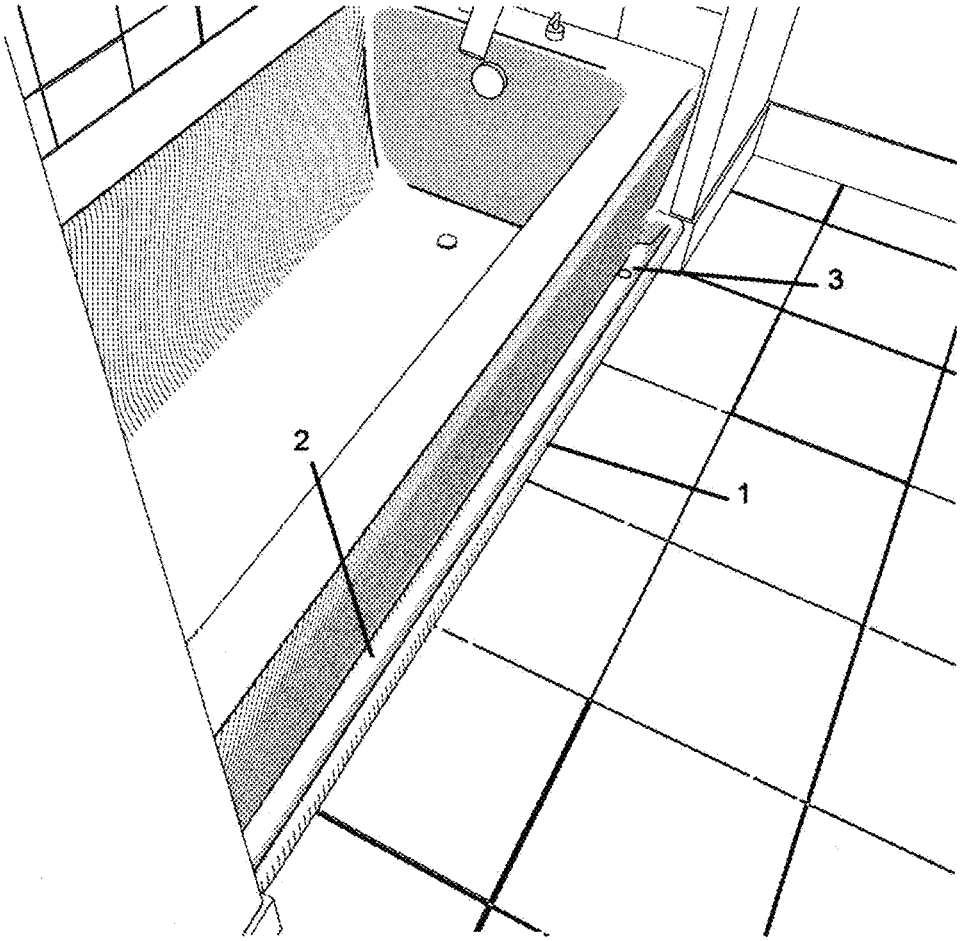
Figure 6:
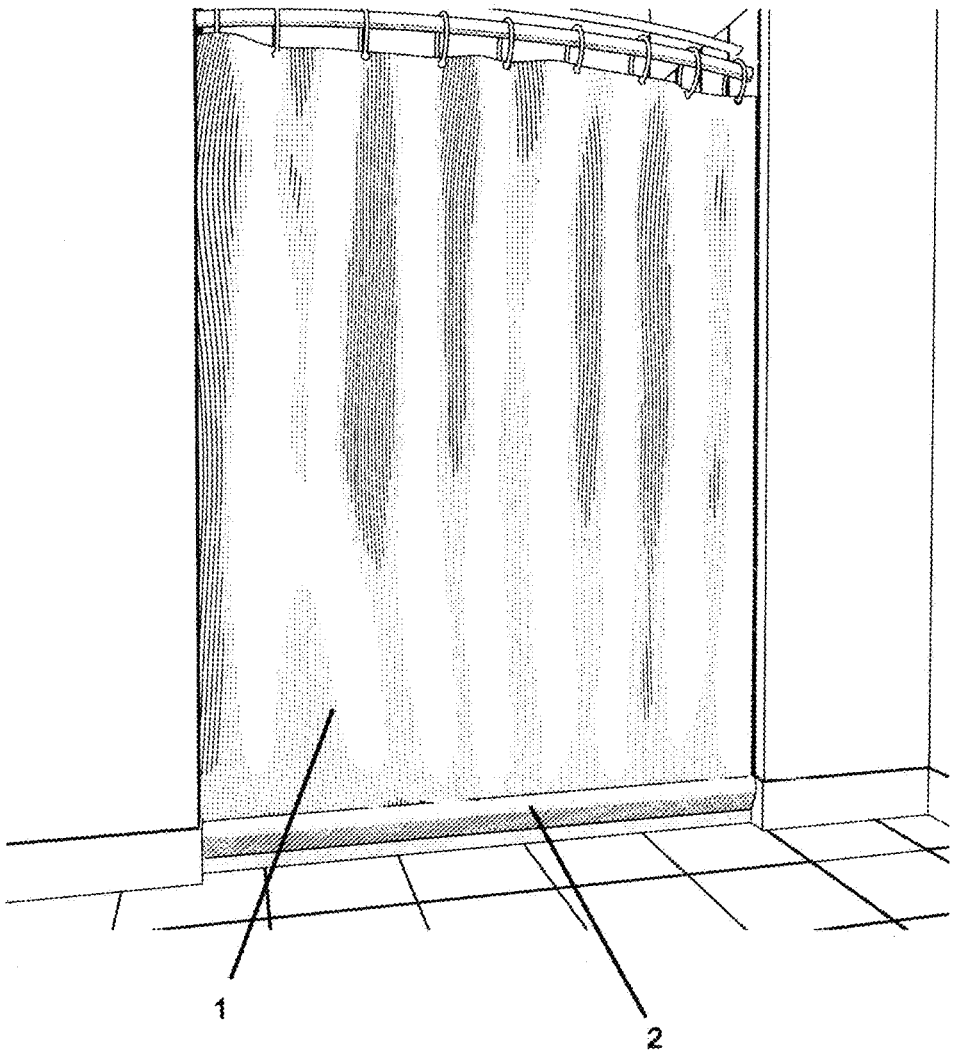

However, if the choice entails taking a shower, the results could means water on bathroom floor. Water on the floor presents a safety hazard that the elderly and very young find difficult to negotiate. Therefore there is a need to prevent water from exiting the bath tub and shower enclosure. What is new about this device or this tub & shower modification is its ability to keep bathroom floor dry, during the bathing process. It does this by redirecting the water back into the tub's own drainage system through a combination usage of shower curtains, water shields and a modified drainage system.

1 Claim, 6 Drawing Sheets

DRY FLOOR BATH TUB

Keeping up with hygiene is a good idea, but watch your step. The bathroom is full of ways to hurt yourself- and a new report estimates that nearly a quarter of a million Americans age 15 or older can back that up.

Bathing and showering appear to be particularly dangerous. Overall, about two-thirds of accidental injuries happen in the bathtub or shower—which makes sense, because each can become slippery.

Overall, mishaps near the bathtub, shower, toilet and sink caused an estimated 234,094 nonfatal injuries in the U.S. in 2008 among people at least 15 years old, the Centers for Disease Control and Prevention reported online in its weekly Morbidity and Mortality Weekly Report. They also reported that injury rate rises with age.

Researchers used emergency room data on accidental, nonfatal injuries and some statistical number crunching to reach their conclusions. Their report is full of statistics on slips, sprains, contusions, fractures and concussions that can happen in the bathroom.

A few other highlights in the report were:

About 81% of injuries were caused by falls.

Women were more likely to be hurt than men.

Two-thirds of all injuries occurred in the tub or shower, though only 2.2% occurred while getting into the shower or tub Overall, only 1% of accidental nonfatal injuries occurred in the bathroom, but for those 65 and older, 2.5% occurred in the bathroom.

While people have long known that the bathroom can be a hazardous area for slips and falls, the new report is the first to quantify how many people suffer injuries in the bathroom and under what circumstances.

Clearly the primary reason the bathroom is a hazardous area is because of the slippery of the floor caused by water or condensation. This along with the fact that shoes or some other form of floor gripping materials are not normally worn in the bathroom when taking a bath, this can lend itself to a dangerous slippery situation that often end in injuries.

The primary way water in bathrooms get on the floor is through overspills from the bath tub. The 'Dry Floor Bathtub System' was invented to keep over spilled water off the floor.

DESCRIPTION

Modification to Bath Tub & Shower Combo

This invention consists of the modification of a regular, traditional bath tub and shower combination. The modified bath tub along with the shower curtains here after will be referred to as the system. The system s designed to prevent water from the bathing process from falling onto the floor, thereby creating a safety hazard.

The modification to a traditional bath tub & shower combo begin with a slot cut into the front side of the tub through the decorative paneling the length of the tub. The decorative panel main purpose is for aesthetics however, behind it there is an empty space enclosed between the exterior decorative panel and an interior panel the interior panel is affixed to the actual tub. That space will be referred to as the or enclosure. Through the slot, a shield is inserted. The shield extends upward through the slot for a height of 4 inches, creating a cavity between the shield and the decorative paneling. This cavity is the space that will house the bottom end of the shower curtains. As the curtains hangs into this cavity, splashed or spilled water from the bathing process will be blocked and captured by the curtains and directed downward into the housing. Inside the housing there lies a trough which captures the water and channels it to a drain hole drilled into the front end of the trough, through which the water will drain. Upon draining into the hole, the water is hosed to the bath tub's trap, from which it is disposed.

The cavity in which the curtains hangs, also serves to stabilize the curtains and keep it in place even when the pressure from the splashing water pushes against it.

The shield not only extends through and parallel the decorative panel, it also extends downward into the housing and connects to the trough. The trough is a basin on which the water fall to be channeled off. The trough is enclosed by an interior panel and the interior portion of the shield on opposite sides and then two end paneling at opposite end of the trough.

The shower curtains, besides performing the traditional duties of curtains, in this system, they also directs the flow of water; therefore the term alternative use, will be use to denotes this additional application for curtains.

The shield is not an add on nor is it an attachment, but a continuous extension of the tub's decorative paneling.

The shield along with the shower curtains, direct the spilled water from the showering process into a trough embedded inside the bath tub's wall, where it is channeled into a drain hose to be dumped into the tub's drainage system.

The drain hose is designed to be easily installed; simply slide one end of the hose over the drain stem protruding through a hole on the underside of the trough. Then connect the other end to the top portion of the trap, that also has a stem protruding out.

The very top of the shield is designed to prevent injuries by someone inadvertently stepping onto this extension when exiting the tub.

The drain hose or drain line also referred to as the line or hose serves to connect the trough to the trap.

During the showering process water that splashes off the individual will alternatively be referred to as splashed, splashing or spilled water. This is water if not captured will become a safety hazard on the floor.

The trough is a basin within the interior wall of the tub, on which water travels to a drain hole drilled within the trough, to allow it to be drained off by way of a drain hose.

The trough is installed with a slight slope toward the front of the tub so that the water could be easily drained off, propelled by force of gravity.

SUMMARY OF INVENTION

Briefly described, the present invention includes in its most preferred embodiment, a modification to an average bath tub that would redirect water that would have fallen onto the bathroom floor (during the bathing or showering process) back into the tub's drainage system. This modification prevents any water from escaping the environment of the bath tub, thereby greatly enhancing personal safety.

This modification includes a four (4) inch high shield which extends the full length of the tub. The shield starts at the trough and extends through the side of the tub and turn vertical to a height of 4 inches upon exiting the side of the tub. The shield helm to form a housing cavity which house the bottom end of shower curtains that help channel all water that otherwise would have fallen on the floor, into a trough embedded within the side of the tub, where it may be drained off. Underneath the trough a drain hose is attached to drain the water from the trough to the tub's drainage system.

The trough has a slight decline from the back to the front of the tub. This decline serves to gives the water within the trough the momentum needed to flow to the drain hole and eventually into the drainage system. The front of the tub, is the area where all the fittings and fixtures are located.

This system as designed is effective and user friendly.

BACKGROUND OF THE INVENTION

The present invention relates generally to the field of home improvement and more specifically, the field of home and hotel bathroom safety.

It is well known that the bath room can be a dangerous place, especially if the bathroom floor is wet. This could be especially precarious if you was a senior or a very young person whose mobility is limited or impaired. Thousands of individuals are injured annually from slip and falls in the bathroom resulting from wet floors. For establishments such as hotels, the liability cost, could mount into the millions.

Currently, individuals are resorting to placing towels or some other water absorbing material on the floor to reduce the likely hood of a fall. However, these measures are of limited value because they too become inundated with moisture and when stepped on, the moisture attaches to the feet thereby offering very little resistance against slips and falls.

There are other devices and measures being deplored that attempt to address this issue, however none have proven to be effective and user friendly. Including the measure of placing the shower curtains inside the tub. This measure necessitates the cleaning and or replacing the curtains on a frequent basis because they become soiled quickly and no one wants to take a bath with a filthy shower curtain inside the tub with them.

Therefore there is a need in the industry for a way to keep the bath room floor dry and do so without having the user to perform cumbersome measures to achieve it. This invention fit that bill, because it is user friendly and effective.

DETAILED DESCRIPTION OF THE DRAWINGS

Referring now in greater detail to the drawings in which like numerals represent like components throughout the several views

FIG. 1:

Line #10 this area is the cavity, this is where the bottom end of the shower curtains will hang into in order to direct splashed water into the housing area.

Line #9 represents the top part of the decorative paneling. The paneling has been modified to accommodate the insertion of the shield.

Line #8 represents the 4 inch high shield that extends the full length of the tub. The shield is attached to the trough which is embedded inside the space between the paneling and the tub's outer wall. Attached to the trough the shield extends upward through the paneling then turn vertical to a height of four (4) inches.

Line #7 represents the housing, an area between the interior part of the shield and an interior wall affixed to the tub's outer wall. This is the area that will hold the water until it is drained off.

Line #6 represents the bottom part of the decorative paneling.

Line #5 represents the trough. The trough is embedded within the interior of the tub' wall which serves as a channel to direct water to the drain hole located on the trough, so that it may be drained off. The trough extends the full length of the tub and has a one (1) inch width. The trough is slightly inclined to allow water under its own momentum to run into the drain hole.

Line #4 the drain hose or drain line connects to the bottom of the trough at one end and to the upper part of the trap at the other end. The hose/line serves as a conduit through which the water is directed from the trough to the tub's drainage system. The movement of the water is propelled by gravity.

Line #3 shows the stem/trap connection, thereby the trap's modification.

Line #2 shows the full contour of the trap

Line #1 shows where on the trap the drain hose/line will be attached.

FIG. 2:

Line #1 this is the drain line/hose that attaches to the stem

Line #2 this is the stem which is attached to the trough and extends through the flooring of the trough, where the drain line will connect to it.

FIG. 3:

Line #1 shows the top section of the trap to which the drain line will be connected.

Line #2 shows the stem installed in the top section of the trap

Line #3 Shows the drain line, staged to be attached to the stem

Line #4 shows the deep loop in the trap and the direction the water will flow

FIG. 4:

Line #1 shows the interior panel which help form the housing

Line #2 shows where the stem is installed

Line #3 shows the drain hose attached to the installed stem on the underneath side of the trough Line #4 shows the bottom side of the trough Line #5 shows one of the two end panels, one and each end.

Line #6 shows the area represented by the housing, which extends the length of the tub.

FIG. 5:

Line #1 indicates that the modification represented by the extension of the shield starts two inches off the floor up the side of the tub.

Line #2 shows the opening or cavity where the curtains would hang into during showering process.

Line #3 shows where the drain hole in the trough is located

FIG. 6:

Line #1 shows the shower curtains in operational position. The curtains will block water from leaving the environment of the bath tub and direct said water downward to the trough.

Line #2 Shows a full frontal of the shield, installed.

The invention claimed is:

1. A method for providing a bathtub/shower combination having a drain piping system with a trap, with a shower curtain drainage system, for keeping a bathroom floor dry, consisting of:

a) Modifying a front decorative panel, by making a slot that extends the length of the front decorative panel;

b) Providing a trough having a similar length as the front decorative panel, and having a back wall, a bottom wall and a shield/front wall, such that when the back wall is installed in the slot of the decorative panel the shield extends essentially parallel to the decorative panel, thereby providing a cavity for housing a bottom of the shower curtain;

c) Providing a drain hole in an end of the bottom wall of the trough for channeling splashed water from the shower curtain out of the trough;

d) Providing a hose from the drain hole to the bathtub trap for disposing of the water.

* * * * *